US010632753B2

(12) United States Patent
Niisato et al.

(10) Patent No.: US 10,632,753 B2
(45) Date of Patent: Apr. 28, 2020

(54) METAL MEMBER, LIQUID DISCHARGE HEAD, LIQUID DISCHARGE APPARATUS, AND METHOD FOR MANUFACTURING METAL MEMBER

(71) Applicants: Yoshihide Niisato, Kanagawa (JP); Kenshiroh Munetomo, Kanagawa (JP); Kaname Morita, Kanagawa (JP)

(72) Inventors: Yoshihide Niisato, Kanagawa (JP); Kenshiroh Munetomo, Kanagawa (JP); Kaname Morita, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 15/929,048

(22) Filed: Sep. 25, 2018

(65) Prior Publication Data

US 2019/0193403 A1 Jun. 27, 2019

(30) Foreign Application Priority Data

Dec. 26, 2017 (JP) ..... 2017-250241

(51) Int. Cl.

| | |
|---|---|
| ***C22C 5/04*** | (2006.01) |
| ***B41J 2/16*** | (2006.01) |
| ***B41J 2/14*** | (2006.01) |
| ***C23C 10/60*** | (2006.01) |
| ***C23C 10/28*** | (2006.01) |
| *C23C 30/00* | (2006.01) |

(52) U.S. Cl.

CPC ..... *B41J 2/1626* (2013.01); *B41J 2/14274* (2013.01); *C22C 5/04* (2013.01); *C23C 10/28* (2013.01); *C23C 10/60* (2013.01); *B41J 2/1433* (2013.01); *B41J 2202/03* (2013.01); *C23C 30/005* (2013.01)

(58) Field of Classification Search

CPC .... B41J 2/135; B41J 2/14233; B41J 2/14274; B41J 2/1433; B41J 2/162; B41J 2/1623; B41J 2/1626; B41J 2/1628; B41J 2/1629; B05B 1/02; C22C 5/04

See application file for complete search history.

(56) References Cited

U.S. PATENT DOCUMENTS

| | | | | |
|---|---|---|---|---|
| 6,260,960 | B1 * | 7/2001 | Hashizume | B41J 2/14233 347/70 |
| 6,345,880 | B1 * | 2/2002 | DeBoer | B41J 2/14201 347/44 |
| 6,423,476 | B1 * | 7/2002 | Yun | B41J 2/162 347/47 |
| 2003/0154757 | A1 * | 8/2003 | Fukuda | B21D 22/14 72/214 |

(Continued)

FOREIGN PATENT DOCUMENTS

| | | |
|---|---|---|
| JP | 2003-080716 | 3/2003 |
| JP | 2011-088388 | 5/2011 |

(Continued)

*Primary Examiner* — Anh T Vo

(74) *Attorney, Agent, or Firm* — Oblon, McClelland, Maier & Neustadt, L.L.P.

(57) ABSTRACT

A metal member includes an alloy containing platinum-group metal. An amount of the platinum-group metal in an outermost surface of the metal member is higher than the amount of the platinum-group metal in an interior of the metal member.

17 Claims, 9 Drawing Sheets

(56) References Cited

U.S. PATENT DOCUMENTS

| | | | | |
|---|---|---|---|---|
| 2009/0250162 | A1* | 10/2009 | Rivas | B41J 2/1433<br>156/272.2 |
| 2016/0325547 | A1* | 11/2016 | White | B41J 2/3351 |
| 2017/0157924 | A1 | 6/2017 | Otome et al. | |
| 2017/0182768 | A1* | 6/2017 | Porro | B41J 2/1433 |

FOREIGN PATENT DOCUMENTS

| | | |
|---|---|---|
| JP | 2017-061119 | 3/2017 |
| JP | 2017-077639 | 4/2017 |
| JP | 2017-105167 | 6/2017 |
| JP | 2017-189969 | 10/2017 |

* cited by examiner

METAL MEMBER, LIQUID DISCHARGE HEAD, LIQUID DISCHARGE APPARATUS, AND METHOD FOR MANUFACTURING METAL MEMBER

CROSS-REFERENCE TO RELATED APPLICATIONS

This patent application is based on and claims priority pursuant to 35 U.S.C. § 119(a) to Japanese Patent Application No. 2017-250241, filed on Dec. 26, 2017, in the Japan Patent Office, the entire disclosure of which is hereby incorporated by reference herein.

BACKGROUND

Technical Field

Aspects of the present disclosure relate to a metal member, a liquid discharge head, a liquid discharge apparatus, and a method for manufacturing a metal member.

Related Art

In a liquid discharge head that discharges a liquid, a surface of the liquid discharge head is treated with a surface treatment film such as $SiO_2$ to increase the liquid resistance of the metal member forming the liquid discharge head.

A metal member used as a nozzle plate in the liquid discharge head is known. The metal member includes holes penetrating the metal member. The metal member is made of an electroformed alloy containing palladium and nickel. A ratio of palladium to nickel in the electroformed alloy is from 45:55 to 95:5.

SUMMARY

In an aspect of this disclosure, a novel metal member is an alloy containing at least a platinum-group metal. An amount of the platinum-group metal in an outermost surface of the alloy is higher than the amount of the platinum-group metal in an interior of the alloy.

In another aspect of this disclosure, a novel method for manufacturing a metal member includes forming a film of pure palladium layer on a surface of an alloy member containing nickel and palladium using etching gas having an etching rate of palladium higher than an etching rate of nickel, diffusing palladium from the pure palladium layer into the alloy member, and removing the pure palladium layer.

BRIEF DESCRIPTION OF THE DRAWINGS

The aforementioned and other aspects, features, and advantages of the present disclosure will be better understood by reference to the following detailed description when considered in connection with the accompanying drawings, wherein.

Figure 1:
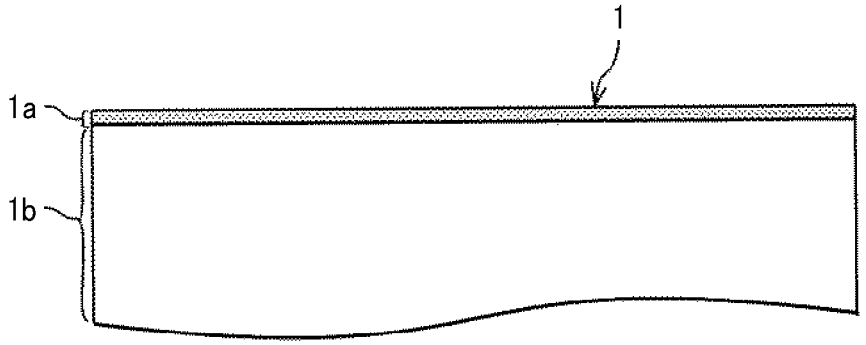
FIG. 1 is a schematic cross-sectional view of a metal member according to a first embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that have the same function, operate in an analogous manner, and achieve similar results.

Although the embodiments are described with technical limitations with reference to the attached drawings, such description is not intended to limit the scope of the disclosure and all the components or elements described in the embodiments of this disclosure are not necessarily indispensable. As used herein, the singular forms "a", "an", and "the" are intended to include the plural forms as well, unless the context clearly indicates otherwise.

In the following, embodiments of the present disclosure will be described with reference to the accompanying drawings. A metal member according to a first embodiment of the present disclosure will be described with reference to FIGS. 1 and 2.

Figure 2:
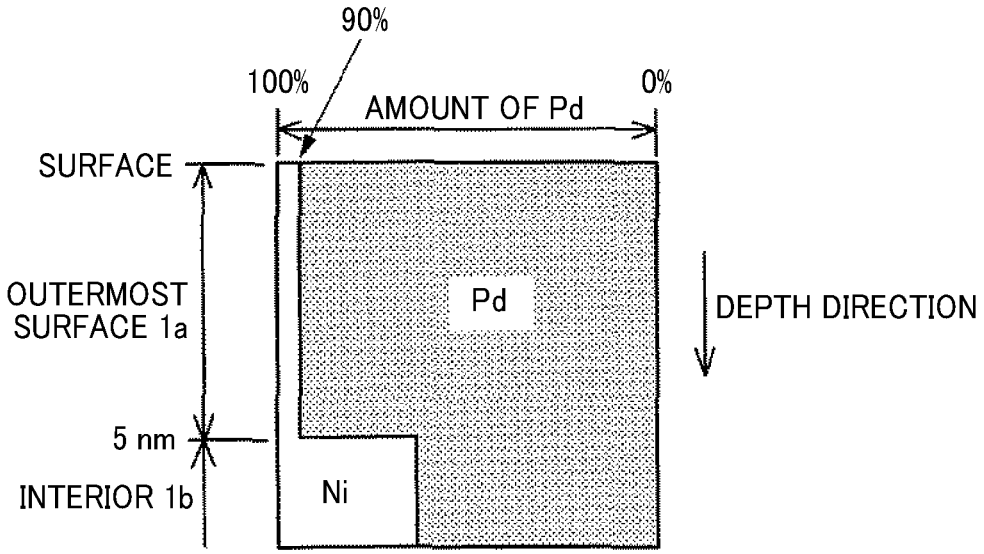
FIG. 2 is a schematic view illustrating a composition of the metal member according to the first embodiment.

FIG. 1 is a schematic cross-sectional explanatory view of the same metal member, and FIG. 2 is a schematic explanatory view of the composition of the metal member.

The metal member 1 is an alloy containing at least a platinum-group metal. In the present embodiment, the metal member is an alloy of palladium (Pd) and nickel (Ni). In the metal member 1, an amount of palladium (Pd) (example of platinum-group metal) in the outermost surface 1*a* is higher than an amount of palladium (Pd) (example of platinum-group metal) in an interior 1*b*.

Here, "outermost surface 1*a*" is defined as a region extending from a surface to a depth of 5 nm of the metal member 1. The amount of the platinum-group metal in the outermost surface 1*a* can be analyzed by, for example, XPS (X-ray photoelectron spectroscopy system). As XPS, for example, K-Alpha (registered trademark) made by Thermo Fisher Scientific K. K. can be used.

In the metal member 1, the amount of palladium (Pd) in the outermost surface 1*a* is set to 90% or more and less than 100%, and the amount of palladium (Pd) in the interior 1*b* is set to be less than 90%. The interior 1*b* is a region from a depth exceeding 5 nm from the surface of the metal member 1 in a depth direction indicated by arrow in FIG. 2.

To improve corrosion resistance, an amount of palladium (Pd) in the outermost surface 1*a* of the metal member 1 is preferably 55% or more, particularly preferably 90% or more and less than 100% as described above. Particularly, when the amount of palladium (Pd) in the outermost surface 1*a* becomes 100%, adhesion of a surface treatment film is considerably reduced. The surface treatment film is a film formed over the surface of the metal member 1. Thus, the amount of palladium (Pd) in the outermost surface 1*a* is set to less than 100%.

As described-above, the amount of the platinum-group metal (palladium (Pd) in this case) in the outermost surface 1*a* is higher than the amount of the platinum-group metal in the interior 1*b* of the metal member 1. Thus, corrosion resistance such as a liquid resistance is improved as compared with the metal member in which the amount of the platinum-group metal in the outermost surface 1*a* is the same as the amount of the platinum-group metal in the interior 1*b*.

Conversely, the amount of the platinum-group metal in the interior 1*b* is lower than the amount of the platinum-group metal in the outermost surface 1*a* in the present embodiment. Thus, the adhesion between the surface of the metal member 1 and the surface treatment film in the present embodiment is improved as compared with the metal member in which the amount of the platinum-group metal in the outermost surface 1*a* is the same as the amount of the platinum-group metal in the interior 1*b*.

That is, when the amount of the platinum-group metal contained in the metal member 1 is uniform between the outermost surface 1*a* and the interior 1*b*, following problem may occur. For example, the adhesion of the surface treatment film is lowered when the amount of the platinum-group metal increases, and the corrosion resistance is lowered when the amount of the group metal is lowered.

Thus, the amount of the platinum-group metal contained in the metal member 1 is made different between the outermost surface 1*a* and the interior 1*b* of the metal member 1 (alloy). The adhesion between the surface of the metal member 1 and the surface treatment film can be improved, and the corrosion resistance can be improved.

Although FIG. 2 illustrates an example in which the amount of the platinum-group metal is changed in two stages between the outermost surface 1*a* and the interior 1*b*, the amount may be changed in three or more stages.

Figure 3:
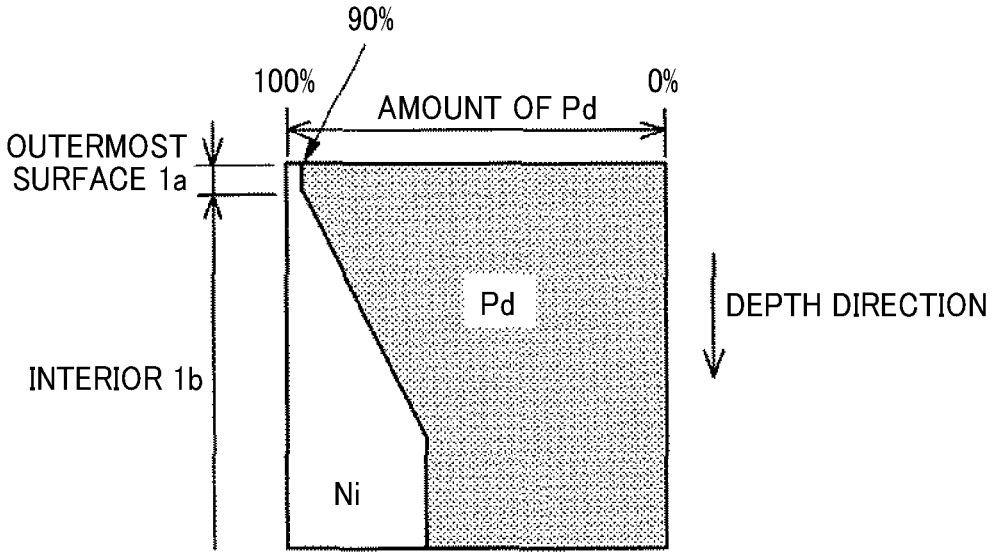
FIG. 3 is a schematic view illustrating composition of a metal member according to a second embodiment of the present disclosure.

Next, a metal member 1 according to a second embodiment of the present disclosure is described with reference to FIG. 3. FIG. 3 is a schematic view of the amount of the metal member 1.

In the present embodiment, the amount of palladium (Pd) gradually decreases from the outermost surface 1*a* to the interior 1*b* of the metal member 1. Conversely, the amount of nickel (Ni) relatively gradually increases from the outermost surface 1*a* to the interior 1*b* of the metal member 1. Thus, a gradient (inclined) amount is formed from the outermost surface 1*a* to the interior 1*b* of the metal member 1.

Here, the amount of palladium (Pd) in the outermost surface 1*a* is set to 90% or more and less than 100%, and the amount of nickel (Ni) increases by 5% or more at a depth of 10 nm from the outermost surface 1*a* of the metal member 1 (alloy) with reference to the amount of the outermost surface 1*a* of the metal member 1 (alloy).

Thus, the present embodiment can reliably secure good adhesion between the surface of the metal member 1 and the surface treatment film.

Figure 4:
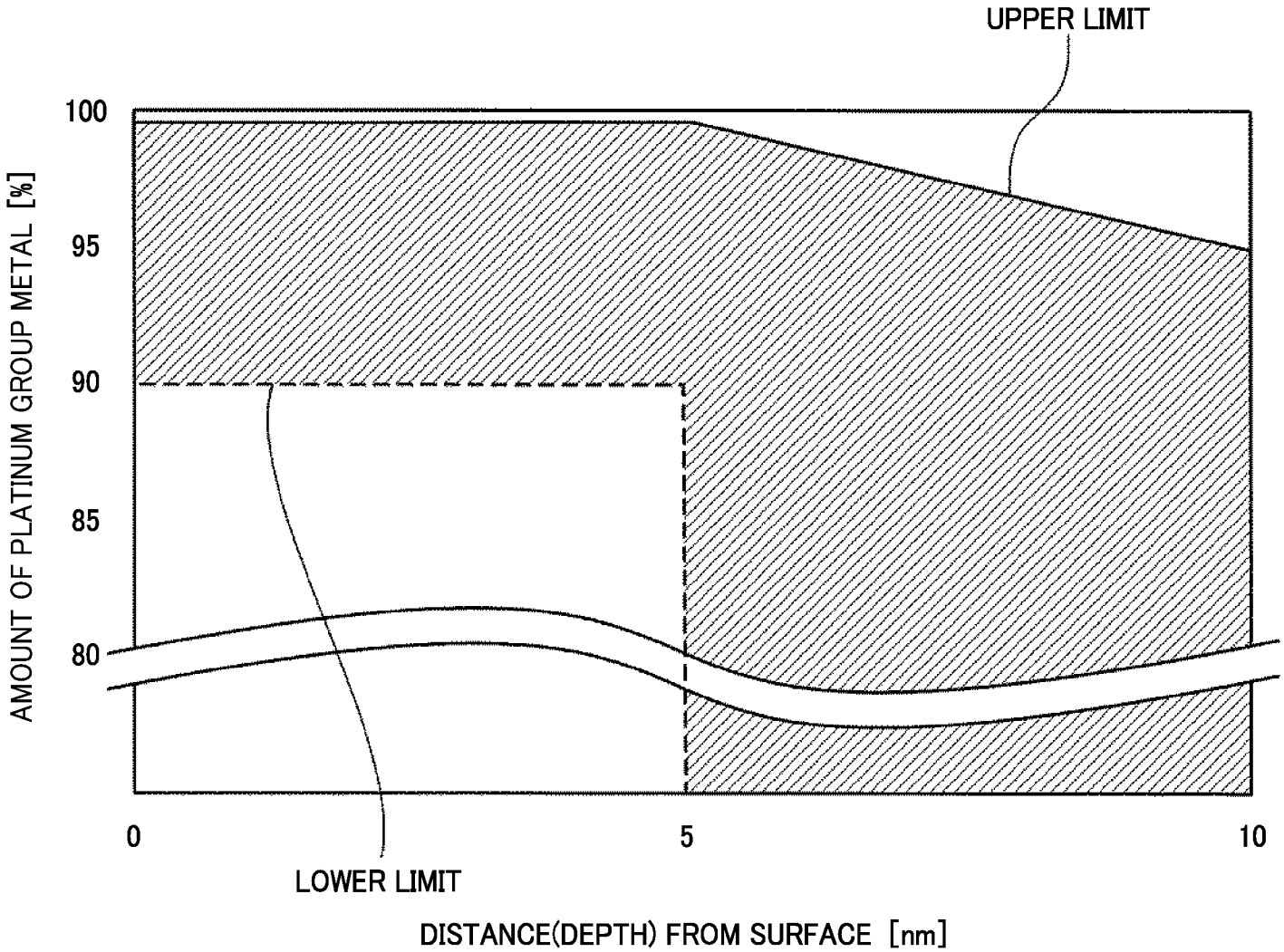
FIG. 4 is a schematic view illustrating a relation between a distance from a surface of the metal member and an amount of a platinum-group metal.

Next, a relation between the depth from the surface of the metal member 1 and the amount of the platinum-group metal is described with reference to FIG. 4. FIG. 4 is a schematic view of the amount of the metal member 1.

As described-above, in the preferred embodiment, the amount of the platinum-group metal is set to 90% or more and less than 100% in the outermost surface 1*a* to secure corrosion resistance. The amount of the platinum-group metal at a depth of 10 nm from the surface of the metal member 1 is set less than 95% to secure the adhesion. That is, the amount of nickel (Ni) increases by 5% or more from the depth of 10 nm from the surface to the metal member 1 with reference to the amount of the outermost surface 1*a*.

FIG. 4 illustrates the above-described configuration. In FIG. 4, an upper limit of the amount of the platinum-group metal to achieve both corrosion resistance and adhesion is indicated by a solid line, and a lower limit is indicated by a broken line.

The upper limit, the amount of the platinum-group metal at the outermost surface 1*a* is 95% or more and less than 100%, and the amount of the platinum-group metal decreases to less than 95% from the surface of the outermost surface 1*a* to the depth of 10 nm in the metal member 1.

At the lower limit, the amount of the platinum-group metal at the outermost surface 1*a* is 90%, and the amount of the platinum-group metal is decreased from the surface toward the interior 1*b* of the metal member 1.

In either case, the amount of the platinum-group metal from the surface to the depth of 5 nm in the metal member 1 is 90% or more and less than 100%, and the amount of the platinum-group metal is less than 95% from the surface to the depth of 10 nm in the metal member 1. Both good corrosion resistance and good adhesion can be satisfied in a region (a shaded region) between the upper limit and the lower limit.

The gradient composition may have a configuration in which the amount of palladium (Pd) gradually decreases with depth from the outermost surface 1*a*. The gradient composition may also have a configuration in which the amount of palladium (Pd) becomes constant with the increase of the depth from the outermost surface 1*a* from a middle of the depth of the metal member 1.

Next, a method for manufacturing the metal member 1 according to a third embodiment of the present disclosure is described with reference to FIGS. 5A through 5D. FIG. 5A through 5D are schematic view illustrating the method for manufacturing the metal member 1 according to the third embodiment.

Figure 5A:
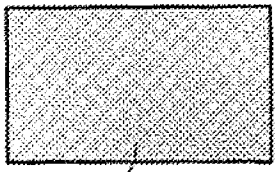
FIGS. 5A through 5D are schematic cross-sectional views of the metal member illustrating a method of manufacturing the metal member according to a third embodiment of the present disclosure.
Figure 5B:
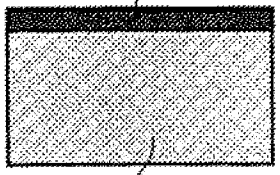

First, as illustrated in FIG. 5A, an alloy 51 containing palladium (Pd) and nickel (Ni) is prepared. Then, as illustrated in FIG. 5B, a process of forming a pure Pd layer 52 on a surface of the alloy 51 (alloy member) is performed using etching gas having a high etching rate to palladium (Pd) and a low etching rate to nickel (Ni). Thus, the etching gas has an etching rate of palladium (Pd) higher than an etching rate of nickel (Ni).

Figure 5C:
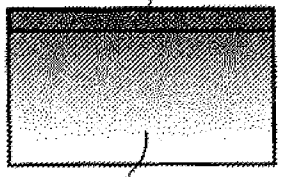

Next, as illustrated in FIG. 5C, a process of diffusing palladium (Pd) from the pure Pd layer 52 toward the alloy 51 is performed. The alloy 51 includes a PdNi layer made of palladium (Pd) and nickel (Ni). Thus, palladium (Pd) in the pure Pd layer 52 is diffused to the PdNi layer in the alloy 51 in the depth direction as indicated in FIG. 3. In this way, the amount of palladium (Pd) gradually decreases from the outermost surface 1*a* to the interior 1*b* of the metal member 1. Conversely, the amount of nickel (Ni) gradually increases from the outermost surface 1*a* to the interior 1*b* of the metal member 1 as illustrated in FIG. 3 and FIG. 5C.

Figure 5D:
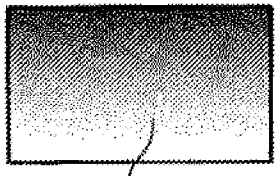

Then, as illustrated in FIG. 5D, a process of removing the pure Pd layer 52 from the surface of the alloy 51 is performed.

Thus, the third embodiment can obtain the metal member 1 containing palladium (Pd) at a required amount on the surface of the alloy 51 at which the amount of palladium (Pd) is higher than the interior of the alloy 51.

In each of the above-described embodiments, the metal member is an alloy of nickel (Ni) and palladium (Pd). However, the metal member 1 may contain a metal other than nickel (Ni).

Next, a liquid discharge head 404 (hereinafter referred to as simply the "head") according to a fourth embodiment of the present disclosure is described with reference to FIGS. 6 and 7.

Figure 6:
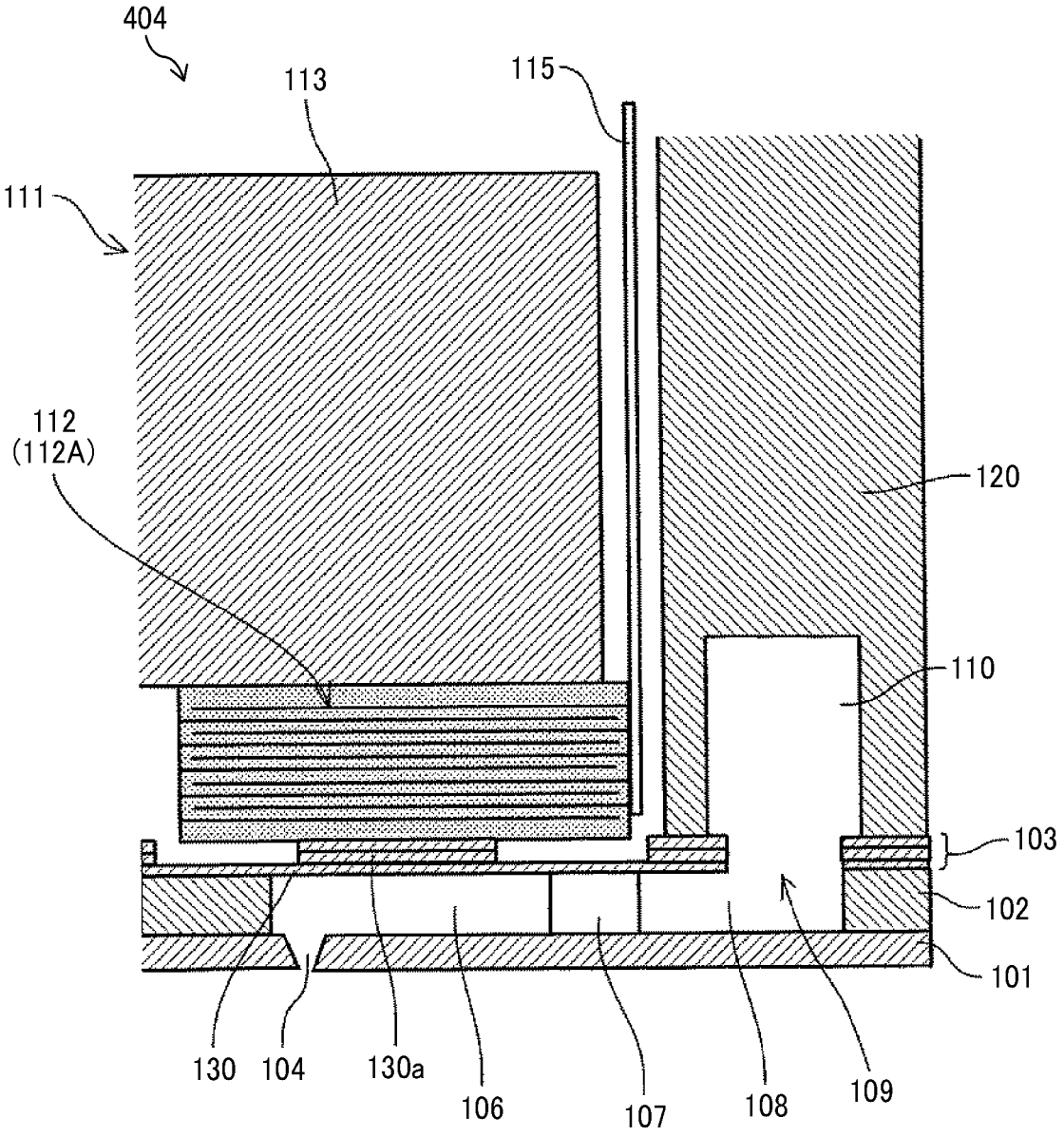
FIG. 6 is a cross-sectional view of a liquid discharge head according to a fourth embodiment of the present disclosure, cut in a direction (the longitudinal direction of individual chamber) perpendicular to a nozzle array direction.
Figure 7:
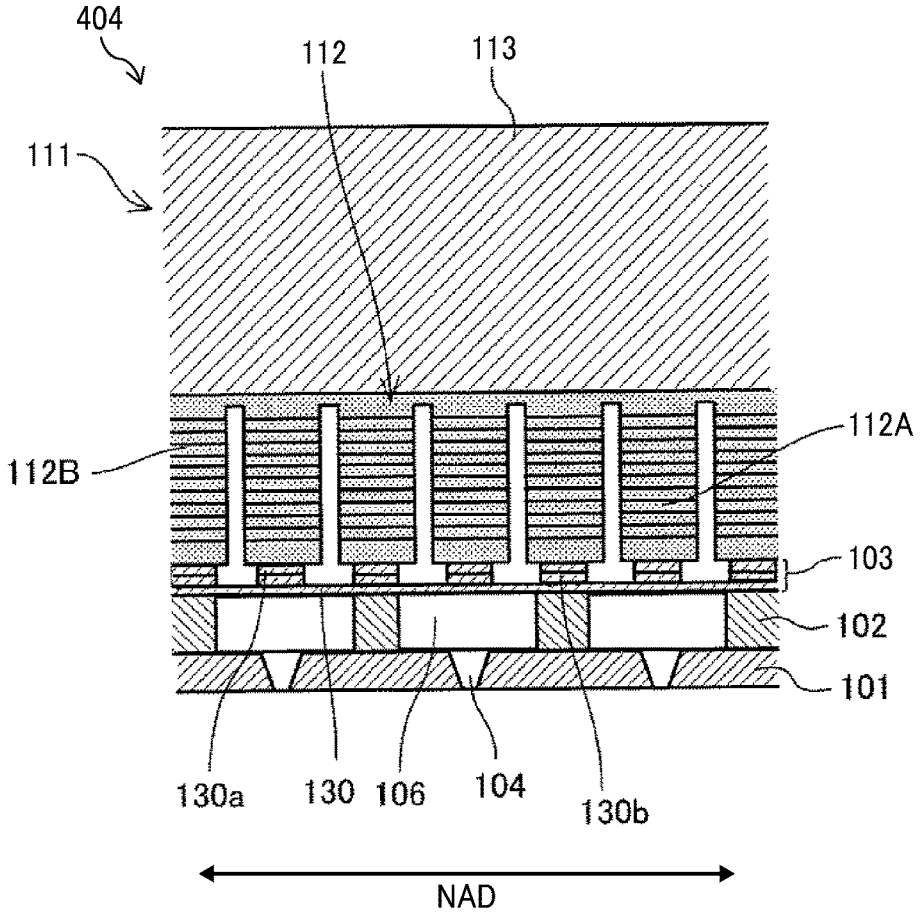
FIG. 7 is a cross-sectional view of the liquid discharge head of FIG. 6 in the nozzle array direction (a transverse direction of the individual chamber)

FIG. 6 is a cross-sectional view of the head 404 in a direction perpendicular to a nozzle array direction in which nozzles 104 are arrayed in rows (a longitudinal direction of individual chambers 106). The nozzle array direction is indicated by arrow "NAD" in FIG. 7. FIG. 7 is a cross-sectional view of the head 404 in the nozzle array direction (transverse direction of individual chamber) of the head 404.

The head 404 includes a nozzle plate 101, a channel substrate 102, and a diaphragm member 103 as wall members that are laminated one on another and bonded to each other. The diaphragm member 103 is constituted by the metal member 1 according to the present embodiment. The metal member 1 is formed from a thin-film member. The head 404 includes piezoelectric actuators 111 to displace a vibration portion 130 of the diaphragm member 103 and a frame member 120 that serves as a common chamber substrate.

The nozzle plate 101, the channel substrate 102, and the diaphragm member 103 form individual chambers 106, fluid restrictors 107, and liquid introduction portions 108. The nozzle plate 101 includes multiple nozzles 104 to discharge liquid. The channel substrate 102 includes through-holes and grooves that form the individual chambers 106, the fluid restrictors 107, and the liquid introduction portions 108. The individual chambers 106 communicate with the nozzles 104. The fluid restrictors 107 supply the liquid to the individual chambers 106. The liquid introduction portions 108 communicate with the fluid restrictors 107, respectively.

Liquid is supplied to the individual chambers 106 from the common chamber 110 as a common channel of the frame member 120 through the opening 109 formed in the diaphragm member 103 via the liquid introduction portions 108 and the fluid restrictors 107.

The diaphragm member 103 is a wall member that forms wall surfaces of the individual chambers 106 of the channel substrate 102. The diaphragm member 103 has a three-layer structure, and a deformable vibration portion 130 (diaphragm) is formed in a portion corresponding to the individual chambers 106. The vibration portion 130 is formed by one of the three layers of the diaphragm member 103 positioned at the channel substrate 102 side.

On the opposite side of the individual chambers 106 of the diaphragm member 103, the piezoelectric actuator 111 includes an electromechanical transducer element as a driver (e.g., actuator, pressure generator) to deform the vibration portion 130 of the diaphragm member 103.

The piezoelectric actuator 111 includes a plurality of lamination-type piezoelectric members 112 bonded on a base 113. The piezoelectric member 112 is groove-processed by half-cut dicing so that each piezoelectric member 112 includes a desired number of pillar-shaped piezoelectric elements 112A and 112B arranged at intervals, in the shape of a comb.

The piezoelectric elements 112A and 112B of the piezoelectric member 112 have the same structure. However, the piezoelectric elements 112A are driven by applying a driving waveform, whereas the piezoelectric elements 112B are used only as a support to support the diaphragm member 103. The driving waveform is not applied to the piezoelectric element 112B.

The piezoelectric element 112A is joined to a convex portion 130*a*, which is a thick portion having an island-like form formed on the vibration portion 130 of the diaphragm member 103. The piezoelectric element 112B is bonded to the convex portion 130*b*, which is a thick portion of the diaphragm member 103.

The piezoelectric member 112 includes piezoelectric layers and internal electrodes that are alternately laminated. The internal electrodes are led out to end faces of the piezoelectric elements 112A and the piezoelectric elements 112B to form external electrodes. The flexible printed circuit (FPC) 115 as a flexible wiring member is connected to the external electrodes of the piezoelectric element 112A to apply a drive signal to the piezoelectric element 112A.

The frame member 120 is formed by injection molding with, for example, an epoxy resin or a thermoplastic resin such as polyphenylene sulfite, and a common chamber 110 to which the liquid is supplied from a head tank or a liquid cartridge is formed.

In the head 404, for example, when the voltage applied to the piezoelectric element 112A is lowered from a reference potential, the piezoelectric element 112A contracts. As a result, the vibration portion 130 of the diaphragm member 103 is pulled and the volume of the individual chambers 106 increases, thus causing liquid to flow into the individual chambers 106.

When the voltage applied to the piezoelectric element 112A is raised, the piezoelectric element 112A expands in the direction of lamination. The vibration portion 130 of the diaphragm member 103 deforms in a direction toward the nozzle 104 and contracts the volume of the individual chambers 106. As a result, the liquid in the individual chambers 106 is squeezed and the liquid is discharged (ejected) from the nozzle 104.

Then, by returning the voltage applied to the piezoelectric element 112A to the reference potential, the vibration portion 130 of the diaphragm member 103 is restored to its initial position, and the individual chambers 106 expand to generate a negative pressure. In this case, the liquid is supplied from the common chamber 110 to the individual chambers 106. After vibration of the meniscus of the nozzle 104 is attenuated and stabilized, the next droplet discharge is started.

Note that the driving method of the head 404 is not limited to the above-described pull-push discharge example, and alternatively, for example, pull discharge or push discharge may be performed in response to the way to apply the drive waveform.

Figure 8:
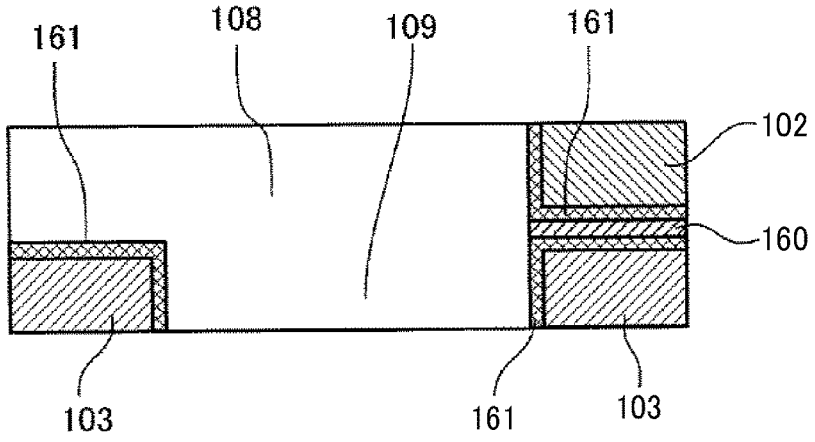
FIG. 8 is an enlarged view of a bonding portion between a channel substrate and a diaphragm member in the liquid discharge head.

FIG. 8 is an enlarged cross-sectional view of a joint portion between the channel substrate 102 and the diaphragm member 103 in the head 404. In the present embodiment, the diaphragm member 103 and the channel substrate 102 are bonded together by an adhesive 160. At this time, a surface-treatment film 161 for enhancing bonding strength and liquid resistance is formed on surfaces of the diaphragm member 103 and the channel substrate 102. The surface-treatment film 161 is also referred to as an adhesion film. A surface treatment film is also formed on a surface of the nozzle plate 101 that is bonded to the channel substrate 102.

Here, the diaphragm member 103 is formed of an alloy containing nickel (Ni) and palladium (Pd). A wall surface of an opening 109 of the diaphragm member 103 is required to have a liquid resistance because the wall surface of the opening 109 is exposed to liquid. Further, the surface-treatment film must adhere securely to a bonding surface of the diaphragm member 103 bonded to the channel substrate 102 to strengthen bonding.

In this case, when the amount of palladium (Pd) in the portion bonded to the channel substrate 102 reaches 100%, the adhesion of the surface-treatment film 161 is considerably reduced. Further, the adhesion of the surface-treatment film 161 increases with an increase of the amount of nickel (Ni) in the alloy (diaphragm member 103). However, the higher the amount of nickel (Ni), the lower the corrosion resistance of the alloy. Further, when the surface-treatment film 161 is formed, not only the amount of nickel (Ni) in an outermost surface 1*a* but also the amount of nickel (Ni) in the interior 1*b* influence the adhesion since the surface-treatment film penetrates the interior 1*b* of the alloy (diaphragm member 103).

Thus, as described in the above-described embodiment, the diaphragm member 103 includes the metal member 1, the amount of the platinum-group metal on the outermost surface 1*a* of which is higher than the amount of the platinum-group metal in the interior 1*b*.

As a result, the corrosion resistance of the diaphragm member 103 at the opening 109 and the like can be improved, and the adhesion with the surface-treatment film 161 can also be improved.

Note that the head device formed of the metal member according to the present disclosure is not limited to the diaphragm member 103. The nozzle plate 101, the channel substrate 102, and the like may also be constituted by the metal member according to the present disclosure.

Further, usage of the metal member according to the present embodiment is not limited to the head device. The metal member may be used for any member that requires an adhesion to the surface-treatment film and a corrosion resistance.

Figure 9:
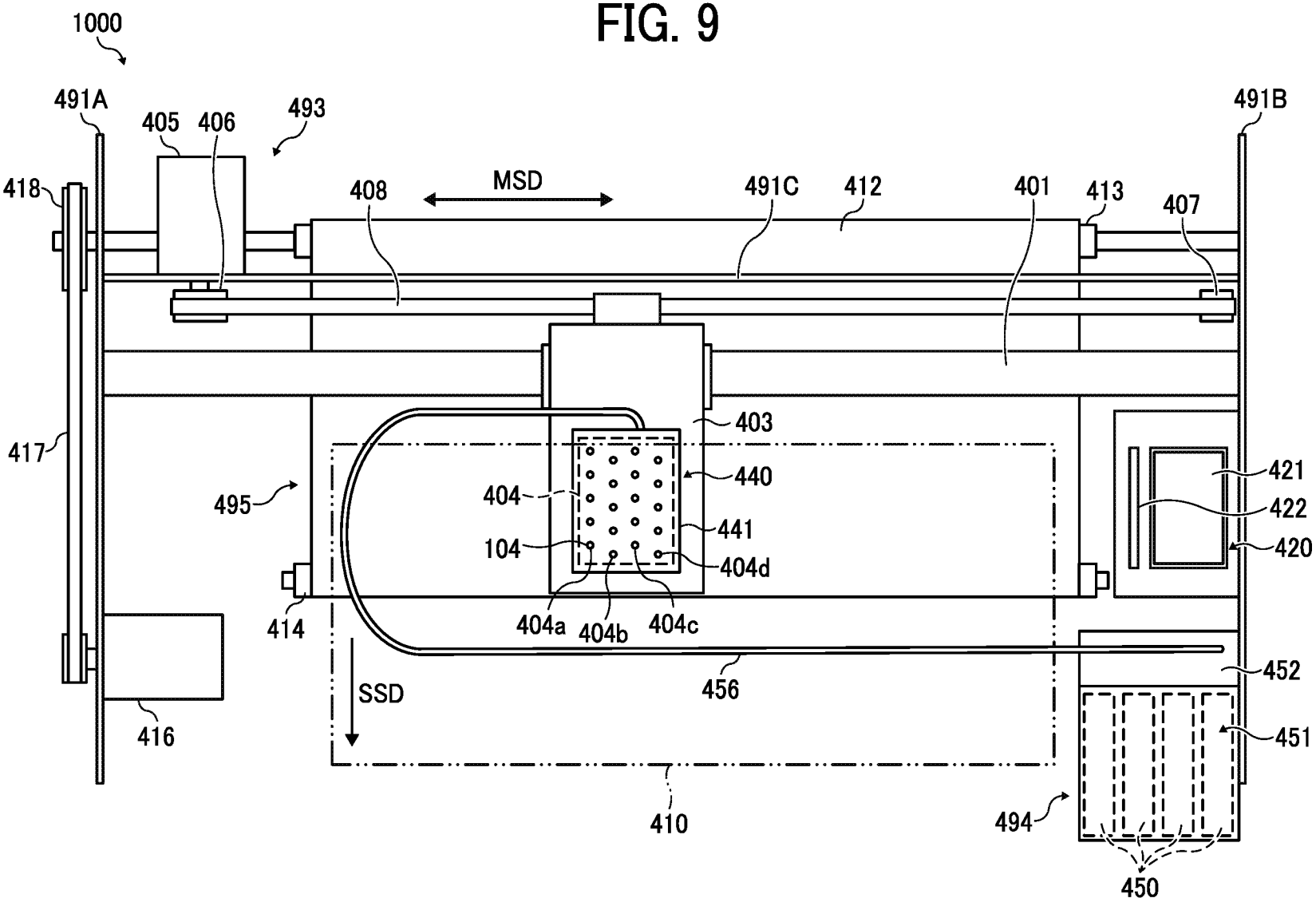
FIG. 9 is a plan view of a portion of a liquid discharge apparatus according to the present disclosure.
Figure 10:
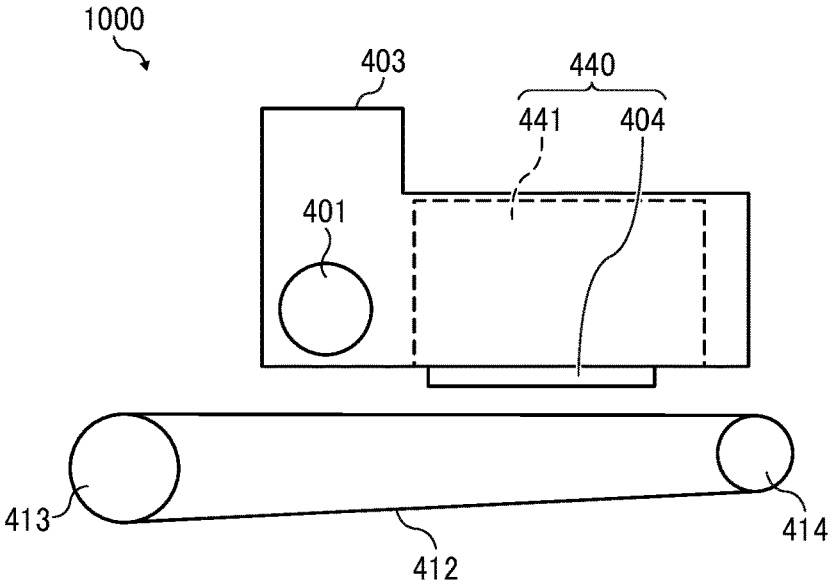
FIG. 10 is a side view of a portion of the liquid discharge apparatus.

Next, a liquid discharge apparatus according to an embodiment of the present disclosure is described with reference to FIGS. 9 and 10. FIG. 9 is a plan view of a portion of the liquid discharge apparatus according to an embodiment of the present disclosure. FIG. 10 is a side view of a portion of the liquid discharge apparatus of FIG. 9.

A liquid discharge apparatus 1000 according to the present embodiment is a serial-type apparatus in which a main scan moving unit 493 reciprocally moves a carriage 403 in a main scanning direction indicated by arrow MSD in FIG. 9. The main scan moving unit 493 includes a guide 401, a main scanning motor 405, a timing belt 408, and the like. The guide 401 is bridged between the left side plate 491A and right side plate 491B to movably hold the carriage 403. The main scanning motor 405 reciprocates the carriage 403 in a main scanning direction via the timing belt 408 bridged between the driving pulley 406 and the driven pulley 407. The main scanning direction is indicated by arrow MSD in FIG. 9.

The carriage 403 mounts a liquid discharge device 440 in which the head 404 according to the present embodiment and a head tank 441 are integrated as a single unit. The head 404 of the liquid discharge device 440 discharges liquid of each color, for example, yellow (Y), cyan (C), magenta (M), and black (K). The head 404 includes nozzle arrays 404*a*, 404*b*, 404*c*, and 404*d*, each including a plurality of nozzles 104 arrayed in row in a sub-scanning direction, which is indicated by arrow SSD in FIG. 9, perpendicular to the main scanning direction MSD. The head 404 is mounted to the carriage 403 so that ink droplets are discharged downward.

The liquid stored in the liquid cartridge 450 is supplied to the head tank 441 by a supply unit 494 for supplying the liquid stored outside the head 404 to the head 404.

The supply unit 494 includes a cartridge holder 451 which is a filling section for mounting the liquid cartridge 450, a tube 456, a liquid feed unit 452 including a liquid transfer pump, and the like. The liquid cartridge 450 is detachably attached to the cartridge holder 451. The liquid is supplied to the head tank 441 by the liquid feed unit 452 via the tube 456 from the liquid cartridge 450.

The liquid discharge apparatus 1000 includes a conveyance unit 495 to convey a sheet 410. The conveyance unit 495 includes a conveyance belt 412 as a conveyance means and a sub-scanning motor 416 for driving the conveyance belt 412.

The conveyance belt 412 attracts the sheet 410 and conveys the sheet 410 at a position facing the head 404. The conveyance belt 412 is an endless belt and is stretched between a conveyance roller 413 and a tension roller 414. Attraction of the sheet 410 to the conveyance belt 412 may be applied by electrostatic adsorption, air suction, or the like.

The conveyance roller 413 is driven and rotated by the sub-scanning motor 416 via a timing belt 417 and a timing pulley 418, so that the conveyance belt 412 circulates in the sub-scanning direction SSD.

At one side in the main scanning direction MSD of the carriage 403, a maintenance unit 420 to maintain and recover the head 404 in good condition is disposed on a lateral side of the conveyance belt 412.

The maintenance unit 420 includes, for example, a cap 421 to cap a nozzle face (i.e., a face on which the nozzles 104 are formed) of the head 404 and a wiper 422 to wipe the nozzle face.

The main scan moving unit 493, the supply unit 494, the maintenance unit 420, and the conveyance unit 495 are mounted to a housing that includes the left side plate 491A, the right side plate 491B, and a rear side plate 491C.

In the liquid discharge apparatus 1000 thus configured, a sheet 410 is conveyed on and attracted to the conveyance belt 412 and is conveyed in the sub-scanning direction SSD by the cyclic rotation of the conveyance belt 412.

The head 404 is driven in response to image signals while the carriage 403 moves in the main scanning direction MSD, to discharge liquid to the sheet 410 stopped, thus forming an image on the sheet 410.

As described above, the liquid discharge apparatus 1000 includes the head 404 according to an embodiment of the present disclosure, thus allowing stable formation of high quality images.

Figure 11:
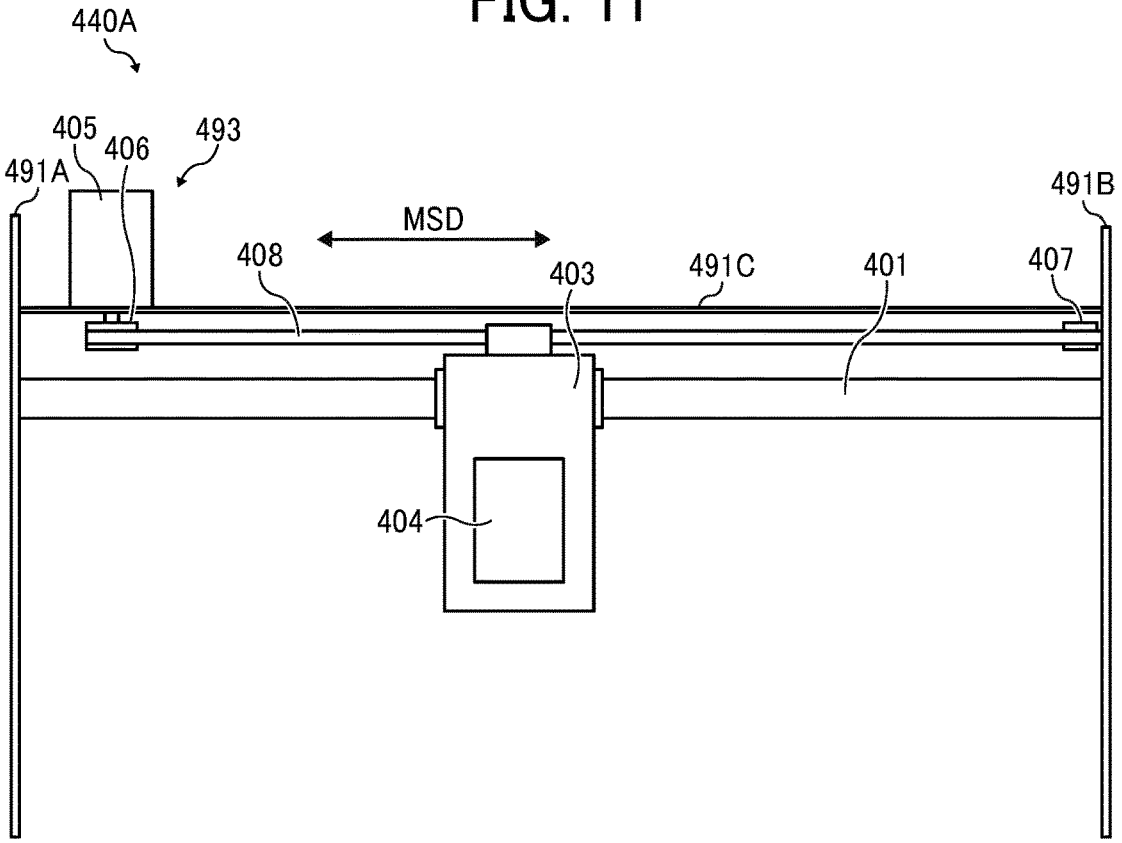
FIG. 11 is a plan view of a portion of another example of the liquid discharge device.

Next, another example of the liquid discharge device 440A according to the present embodiment is described with reference to FIG. 11. FIG. 11 is a plan view of a portion of another example of the liquid discharge device 440A.

The liquid discharge device 440A includes the housing, the main scan moving unit 493, the carriage 403, and the liquid discharge head 404 among components of the liquid discharge apparatus 1000. The left side plate 491A, the right side plate 491B, and the rear side plate 491C constitute the housing.

Note that, in the liquid discharge device 440A, at least one of the maintenance unit 420 and the supply unit 494 described above may be mounted on, for example, the right side plate 491B.

Figure 12:
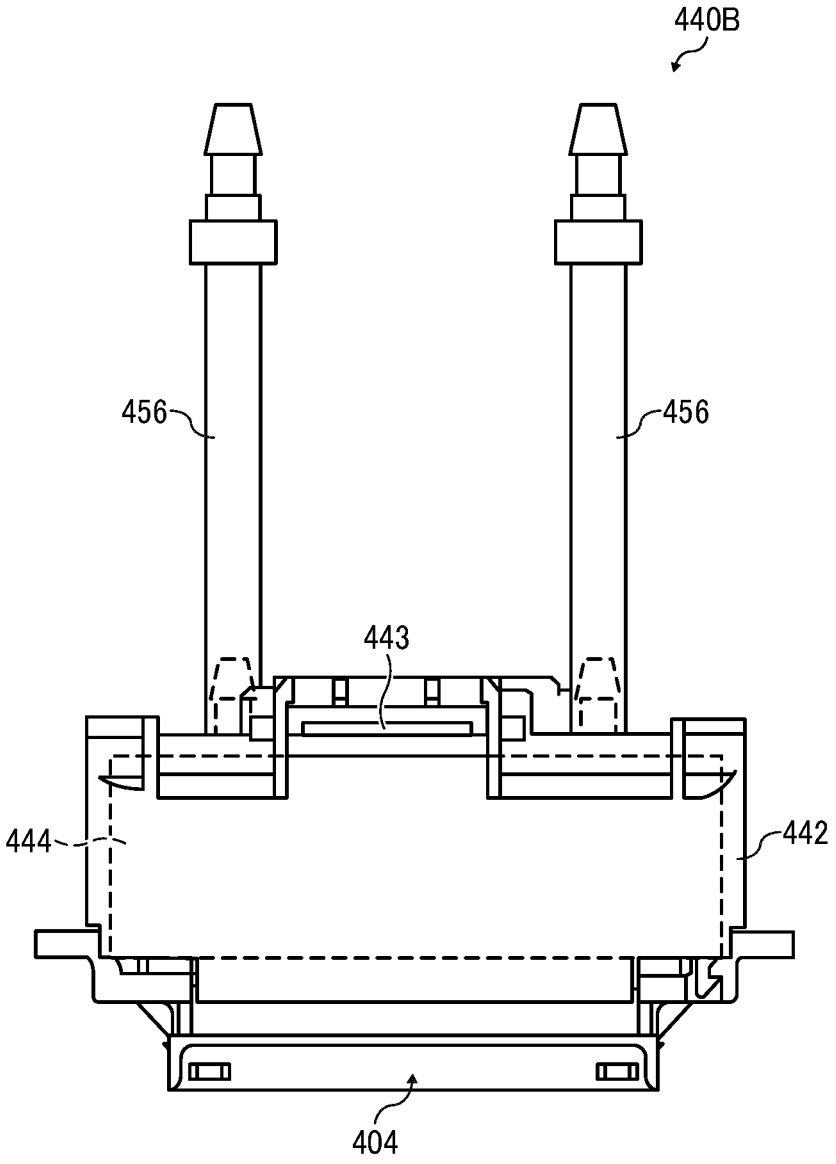
FIG. 12 is a front view of the liquid discharge device according to still another embodiment of the present disclosure.

Next, still another example of the liquid discharge device 440B according to an embodiment of the present disclosure is described with reference to FIG. 12. FIG. 12 is a front view of still another example of the liquid discharge device 440B.

The liquid discharge device 440B includes the head 404 to which a channel part 444 is mounted and a tube 456 connected to the channel part 444.

Further, the channel part 444 is disposed inside a cover 442. Instead of the channel part 444, the liquid discharge device 440B may include the head tank 441. A connector 443 for electrical connection with the head 404 is provided on an upper part of the channel part 444.

In the present embodiment, discharged liquid is not limited to a particular liquid as long as the liquid has a viscosity or surface tension to be discharged from a head (liquid discharge head). However, preferably, the viscosity of the liquid is not greater than 30 mPa·s under ordinary temperature and ordinary pressure or by heating or cooling. Examples of the liquid include a solution, a suspension, or an emulsion that contains, for example, a solvent, such as water or an organic solvent, a colorant, such as dye or pigment, a functional material, such as a polymerizable compound, a resin, or a surfactant, a biocompatible material, such as DNA, amino acid, protein, or calcium, or an edible material, such as a natural colorant. Such a solution, a suspension, or an emulsion can be used for, e.g., inkjet ink, surface treatment solution, a liquid for forming components of electronic element or light-emitting element or a resist pattern of electronic circuit, or a material solution for three-dimensional fabrication.

Examples of an energy source for generating energy to discharge liquid include a piezoelectric actuator (a laminated piezoelectric element or a thin-film piezoelectric element), a thermal actuator that employs a thermoelectric conversion element, such as a heating resistor (element), and an electrostatic actuator including a diaphragm and opposed electrodes.

The liquid discharge device is an integrated unit including the head and a functional part(s) or unit(s) and is an assembly of parts relating to liquid discharge. For example, the liquid discharge device (e.g., the liquid discharge unit) includes a combination of the head with at least one of a head tank, a carriage, a supply device, a maintenance device, and a main scan moving unit.

Examples of the integrated unit include a combination in which the liquid discharge head and one or more functional parts and devices are secured to each other through, e.g., fastening, bonding, or engaging, and a combination in which one of the head and the functional parts and devices is movably held by another. Further, the head, the functional parts, and the mechanism may be configured to be detachable from each other.

For example, the head and the head tank are integrated as the liquid discharge device. Alternatively, the head may be coupled with the head tank through a tube or the like to integrally form the liquid discharge device. A unit including a filter may be added at a position between the head tank and the head of the liquid discharge device.

As another example, the liquid discharge device is an integrated unit in which the head and the carriage are integrated as a single unit.

As still another example, the liquid discharge device is an integrated unit in which the head and the main scanning moving unit are integrated as a single unit. The head is movably held by a guide that forms a part of the main scanning moving unit. The liquid discharge device may include the head, the carriage, and the main scan moving unit that are integrated as a single unit.

As still another example, the liquid discharge device is an integrated unit in which a cap that forms a part of the maintenance unit is secured to the carriage mounting the head so that the head, the carriage, and the maintenance unit are integrated as a single unit.

Further, in another example, the liquid discharge device includes tubes connected to the head tank or the head mounting the channel member so that the head and the supply assembly are integrated as a single unit. Through this tube, the liquid of the liquid storage source such as an ink cartridge is supplied to the head.

The main scan moving unit may be a guide only. The supply unit may be a tube(s) only or a loading unit only.

The term "liquid discharge apparatus" used herein also represents an apparatus including the head or the liquid discharge device to discharge liquid by driving the head. The liquid discharge apparatus may be, for example, an apparatus capable of discharging liquid to a material to which liquid can adhere or an apparatus to discharge liquid toward gas or into liquid.

The liquid discharge apparatus may include devices to feed, convey, and eject the material on which liquid can adhere. The liquid discharge apparatus may further include a pretreatment apparatus to coat a treatment liquid onto the material, and a post-treatment apparatus to coat a treatment liquid onto the material, onto which the liquid has been discharged.

The liquid discharge apparatus may be, for example, an image forming apparatus to form an image on a sheet by discharging ink, or a three-dimensional fabrication apparatus to discharge a fabrication liquid to a powder layer in which powder material is formed in layers to form a three-dimensional fabrication object.

The liquid discharge apparatus is not limited to an apparatus to discharge liquid to visualize meaningful images, such as letters or figures. For example, the liquid discharge apparatus includes an apparatus to form meaningless images, such as meaningless patterns, or fabricate three-dimensional images.

The above-described term "material on which liquid adheres" represents a material on which liquid is at least temporarily adhered, a material on which liquid is adhered and fixed, or a material into which liquid is adhered to permeate. Examples of the "material onto which liquid adheres" include recording media such as a paper sheet, recording paper, and a recording sheet of paper, film, and cloth, electronic components such as an electronic substrate and a piezoelectric element, and media such as a powder layer, an organ model, and a testing cell. The "material onto which liquid adheres" includes any material on which liquid adheres unless particularly limited.

The above-mentioned "material to which liquid adheres" may be any material as long as liquid can temporarily adhere such as paper, thread, fiber, cloth, leather, metal, plastic, glass, wood, ceramics, or the like.

The liquid discharge apparatus may be an apparatus to relatively move the head and a material on which liquid can be adhered. However, the liquid discharge apparatus is not limited to such an apparatus. For example, the liquid discharge apparatus is a serial head apparatus that moves the head, a line head apparatus that does not move the head, or the like.

Examples of the "liquid discharge apparatus" further include a treatment liquid coating apparatus to discharge a treatment liquid to a sheet to coat the treatment liquid on a sheet surface to reform the sheet surface and an injection granulation apparatus in which a composition liquid including raw materials dispersed in a solution is discharged through nozzles to granulate fine particles of the raw materials.

The terms "image formation", "recording", "printing", "image printing", and "fabricating" used herein may be used synonymously with each other.

Numerous additional modifications and variations are possible in light of the above teachings. Such modifications and variations are not to be regarded as a departure from the scope of the present disclosure and appended claims, and all such modifications are intended to be included within the scope of the present disclosure and appended claims.

What is claimed is:

1. A metal member comprising an alloy containing a platinum-group metal, wherein an amount of the platinum-group metal in an outermost surface of the metal member is less than 100% and higher than an amount of the platinum-group metal in an interior of the metal member.

2. The metal member according to claim 1, wherein the outermost surface is a region extending from a surface to a depth of 5 nm of the metal member.

3. The metal member according to claim 1, wherein the amount of the platinum-group metal in the outermost surface of the metal member is 55% or more.

4. The metal member according to claim 1, wherein the amount of the platinum-group metal gradually decreases from the outermost surface to the interior of the metal member.

5. The metal member according to claim 1, wherein the amount of platinum-group metal decreases discontinuously from the outermost surface to the interior of the metal member.

6. The metal member according to claim 1, wherein the platinum-group metal is palladium.

7. The metal member according to claim 1, wherein the alloy contains the platinum-group metal and nickel.

8. The metal member according to claim 1, wherein the metal member is an alloy of palladium and nickel, and an amount of palladium gradually decreases from the outermost surface to the interior of the metal member.

9. The metal member according to claim 1, wherein at a depth of 10 nm from the outermost surface of the metal member, an amount of nickel increases by 5% or more with reference to the amount of nickel in the outermost surface of the metal member.

10. A liquid discharge head, comprising at least one of a diaphragm member, a nozzle plate, and a channel substrate including the metal member according to claim 1.

11. A liquid discharge apparatus comprising the liquid discharge head according to claim 10.

12. The metal member according to claim 1, wherein the amount of the platinum-group metal in the outermost surface of the metal member is 90% or more.

13. The metal member according to claim 1, wherein the amount of the platinum-group metal in the outermost surface of the metal member is 95% or more.

14. The metal member according to claim 1, wherein the metal member comprises the alloy such that the outermost surface of the metal member is made of the alloy.

15. The metal member according to claim 1, produced by a method comprising forming a film of a pure platinum-group metal layer consisting of the platinum-group metal on a surface of an alloy member containing the platinum-group metal, diffusing the platinum-group metal from the pure platinum-group metal layer into the alloy member, and then removing the pure platinum-group metal layer from the alloy member.

16. The metal member according to claim 1, wherein the metal member is an alloy of palladium and nickel, and the metal member is produced by a method comprising forming a film of a pure palladium layer on a surface of an alloy member containing nickel and palladium using etching gas having an etching rate of palladium higher than an etching rate of nickel, diffusing palladium from the pure palladium layer into the alloy member, and then removing the pure palladium layer from the alloy member.

17. A method for manufacturing a metal member, the method comprising:

forming a film of a pure palladium layer on a surface of an alloy member containing nickel and palladium using etching gas having an etching rate of palladium higher than an etching rate of nickel;

diffusing palladium from the pure palladium layer into the alloy member; and removing the pure palladium layer.

* * * * *